United States Patent [19]

Eloranta

[11] Patent Number: 4,678,165

[45] Date of Patent: Jul. 7, 1987

[54] MODE OF CONSTRUCTION OF LIFTING MECHANISMS FOR A JACK-UP PLATFORM AND LIFTING MECHANISM FOR A JACK-UP PLATFORM

[75] Inventor: Jarmo Eloranta, Parkano, Finland

[73] Assignee: Rauma-Repola Oy, Parkano, Finland

[21] Appl. No.: 860,242

[22] Filed: May 6, 1986

[30] Foreign Application Priority Data

May 27, 1985 [FI] Finland ..... 852112
Mar. 26, 1986 [FI] Finland ..... 861311

[51] Int. Cl.[4] ..... B66F 7/12

[52] U.S. Cl. ..... 254/97; 74/410; 74/422; 74/606 R

[58] Field of Search ..... 74/410, 422, 606 R, 74/325; 254/95-97, 89 R, 105; 405/202, 196–199

[56] References Cited

U.S. PATENT DOCUMENTS

| | | | |
|---|---|---|---|
| 2,924,077 | 2/1960 | LeTorneau | 254/95 |
| 3,167,975 | 2/1965 | Durand | 74/410 |
| 4,160,538 | 7/1979 | Armstrong | 254/95 |

*Primary Examiner*—Robert C. Watson
*Attorney, Agent, or Firm*—Murray and Whisenhunt

[57] ABSTRACT

A lifting mechanism (4) operating by means of cogwheels (6) climbing along a toothed rack (3) on the leg (2) of a jack-up platform (1). Lifting mechanisms (4) required for different applications of use, having different capacities of lifting are assembled by using a limited number of different frame modules (5'), climbing pinions (6) and gearings. The torque arms (14) of two gearboxes (7) placed one after the other may be interconnected so that the torques produced by the climbing pinions (6) on the gearboxes compensate for each other.

10 Claims, 26 Drawing Figures

Figure 1:
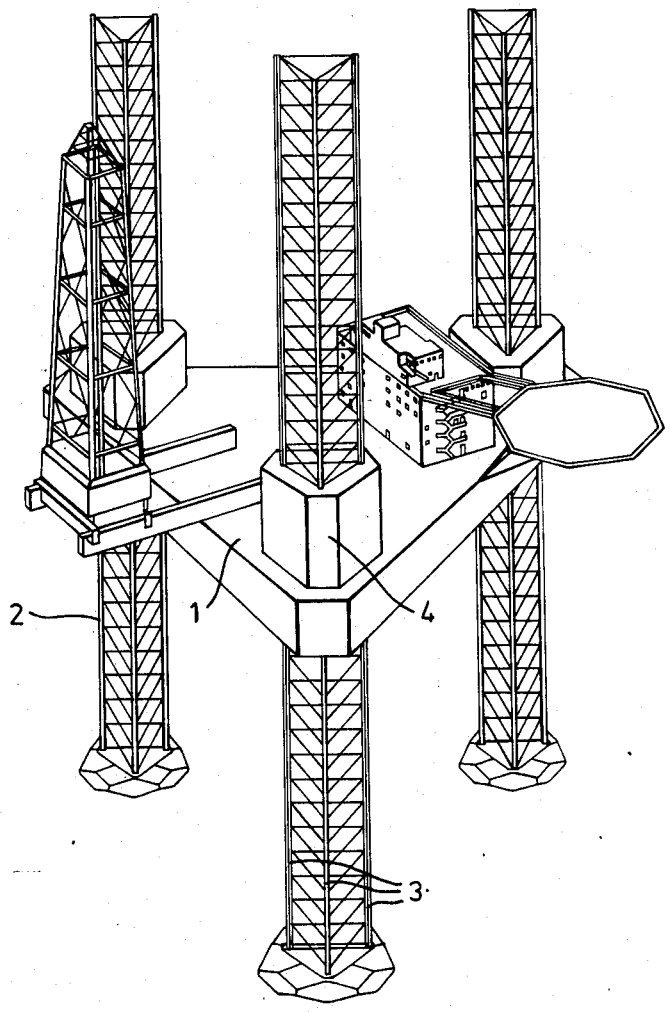
Fig. 1. PRIOR ART

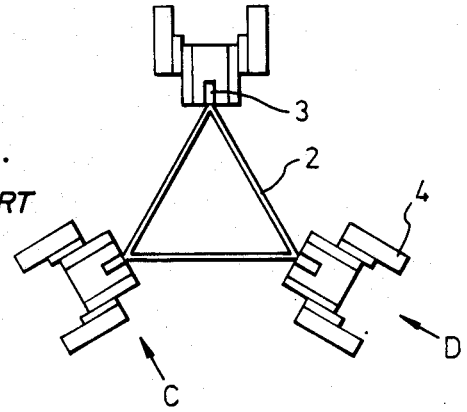
Fig. 6.
PRIOR ART
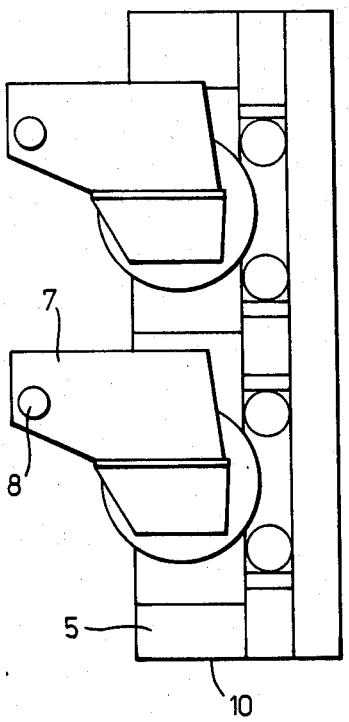
PRIOR ART Fig. 7.
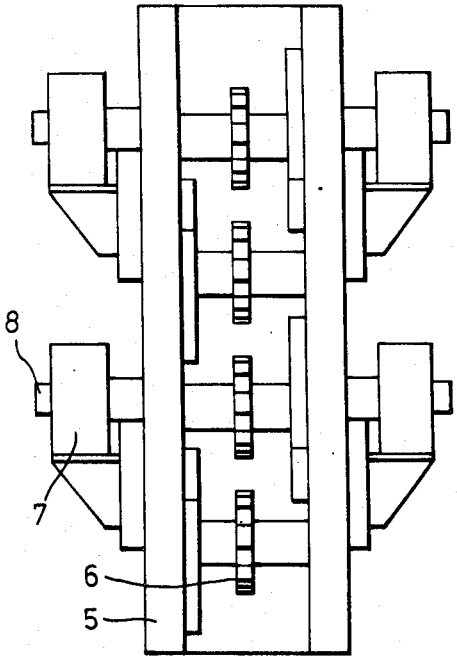
Fig. 8. PRIOR ART

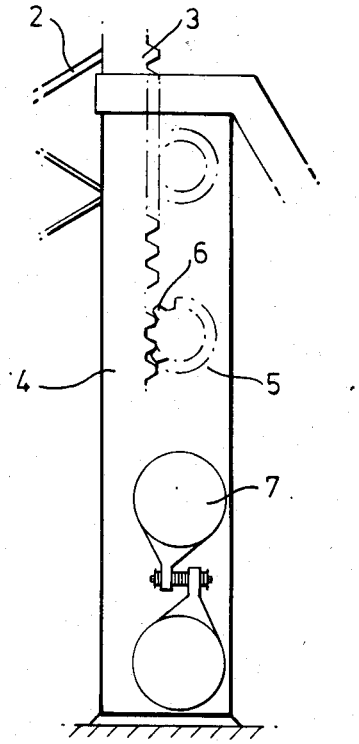
Fig.11.
Fig.12.
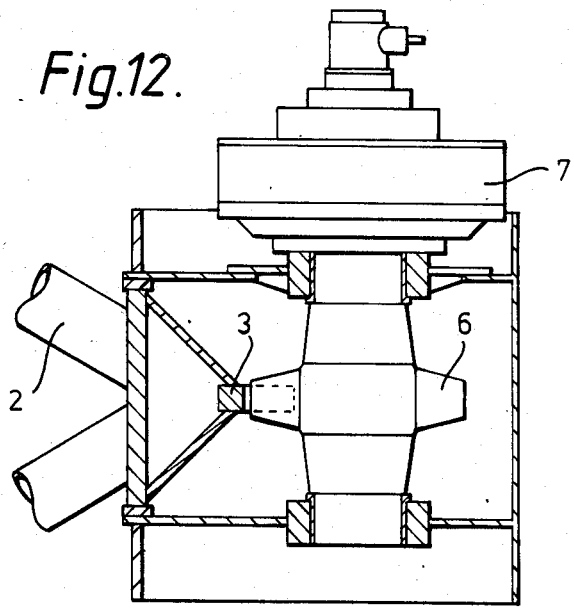

MODE OF CONSTRUCTION OF LIFTING MECHANISMS FOR A JACK-UP PLATFORM AND LIFTING MECHANISM FOR A JACK-UP PLATFORM

The present invention concerns a mode of construction of lifting mechanisms operating by means of cogwheels climbing along a toothed rack on the leg of a jack-up platform, whereby the lifting mechanism consists of a unit composed of one climbing cogwheel or two parallel cogwheels, a drive machine driving each cogwheel, and of a gearing placed between each cogwheel and the drive machine driving the said cogwheel.

The invention also concerns a lifting mechanism for a jack-up platform, which said mechanism comprises a frame, one or several cogwheels climbing along a toothed rack or racks on the platform leg, a drive machine for driving each of the climbing cogwheels, as well as a gearing fitted between each climbing cogwheel and drive machine, whereby each climbing cogwheel or two cogwheels placed side by side, the drive machine driving each cogwheel, and the gearing placed between each cogwheel and its driving drive machine form a separate module.

The lifting of the derrick platform of a jack-up platform used for offshore oil drilling takes place by means of a gear transmission. The cogwheels or pinions climb along toothed racks placed on the corners of the platform legs and lift the derrick platform, attached to the frame of the lifting machine, along with the said pinions. Inside the frame of the lifting machine, there is a necessary number of gear transmissions. As a rule, a lifting machine is constructed as a fully complete unit before it is mounted on the platform.

Of the drawbacks of the lifting machines used at present, e.g., the following should be stated:

Since the drive systems are mainly integrated, their outer dimensions and weights are large, for example, if there are 4 pinions placed one above the other, the height of the structure is about 8 meters and the weight about 90 tons.

The frame of the transmission is used as a part of the supporting structure of the platform, whereby the various horizontal forces coming from the legs may change the form of the frame, which again has a detrimental effect on the contacts of the cogwheels placed inside the frame and, consequently, on the probability of damage, which is increased.

Replacement of spare parts is difficult, and it is almost impossible to carry all the necessary spare parts on board.

The delivery terms of integrated transmissions are long, because the necessary cogwheels are large and there are few manufacturers of such cogwheels. Likewise, with the conventional drive systems, the possibilities of transportation are limited.

Different lifting mechanisms are required for systems of one rack and of two racks.

The mode of construction of a lifting mechanism in accordance with the present invention is characterized in that lifting mechanisms required for different applications of use, having different capacities of lifting, and usable in connection with a one-sided or two-sided toothed rack are assembled by using a limited number of different frame modules, climbing pinions and gearings. The lifting mechanism in accordance with the invention is characterized in that each gearing is a module separate in relation to the frame. A planetary gear is preferably used as gearing.

By means of the lifting mechanism concept in accordance with the invention, it is possible to cover all possible such lifting machine variations for a jack-up platform as are based on a pinion climbing along a toothed rack on the platform leg, while at the same time giving consideration to minimization of the weight of the lifting system.

By means of the invention, it is possible to avoid the above drawbacks of the prior-art lifting mechanisms. Advantages obtained by means of the invention are, in particular:

The lifting mechanism can be replaced easily, and it can also be accomplished by less highly skilled personnel. The spare parts situation is easier, because one complete replacement gearbox can be easily carried along.

Low sensitivity to variations in the shape of the frame.

Owing to a better efficiency of a planetary gear, it is possible to use smaller drive motors.

Shortening of the period of construction of the platform, because the number of manufacturers of smaller-size transmissions is considerably higher than the number of manufacturers of large gearings.

Suitable both for a single-rack construction and for a twin-rack construction by just changing the frame.

Compensation for the forces coming from the pinions by means of gearings placed one after the other or one alongside the other, whereby no separate heavy support structures are required.

Low weight, about 50 to 70 percent of conventional, including the frame.

Easy to handle and to transport, because the transmission part is separate in relation to the frame.

Figure 2:
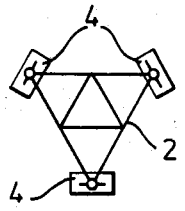
Fig. 2. PRIOR ART
Figure 3:
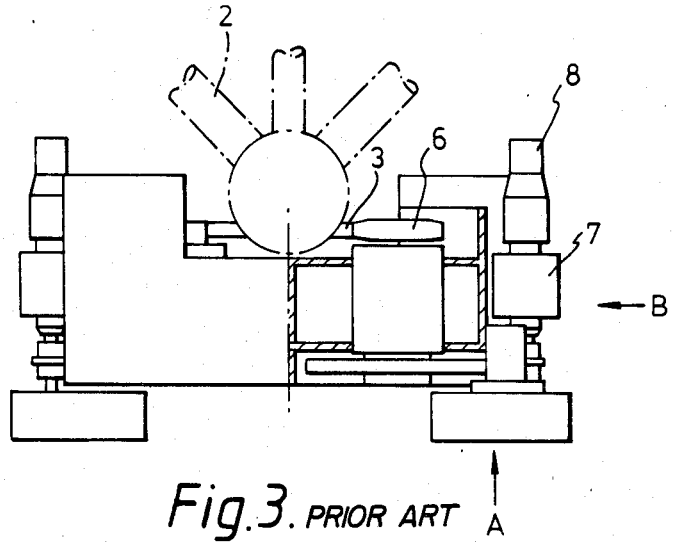
Fig. 3. PRIOR ART
Figure 4:
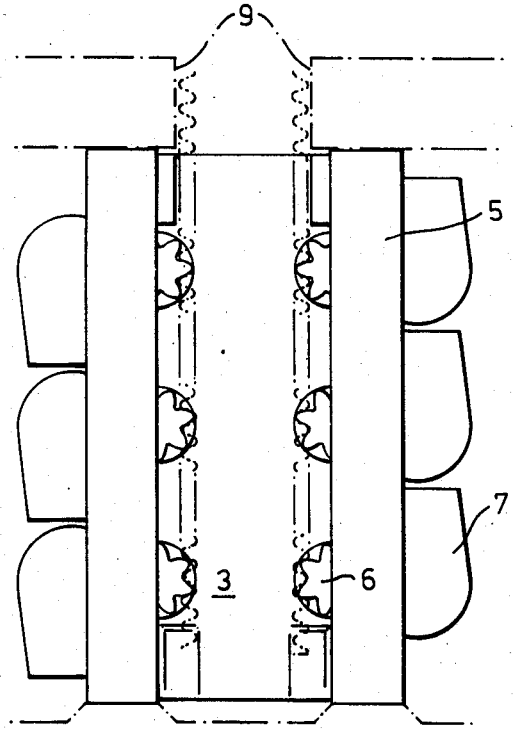
Fig. 4. PRIOR ART
Figure 5:
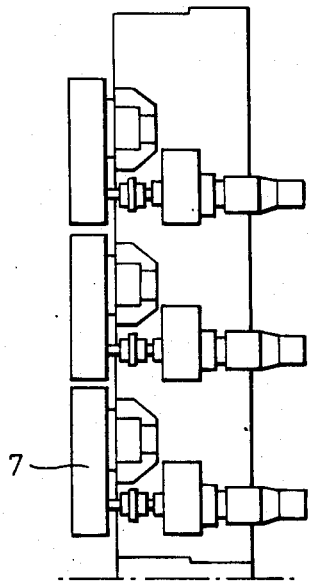
Fig. 5. PRIOR ART
Figure 9B:
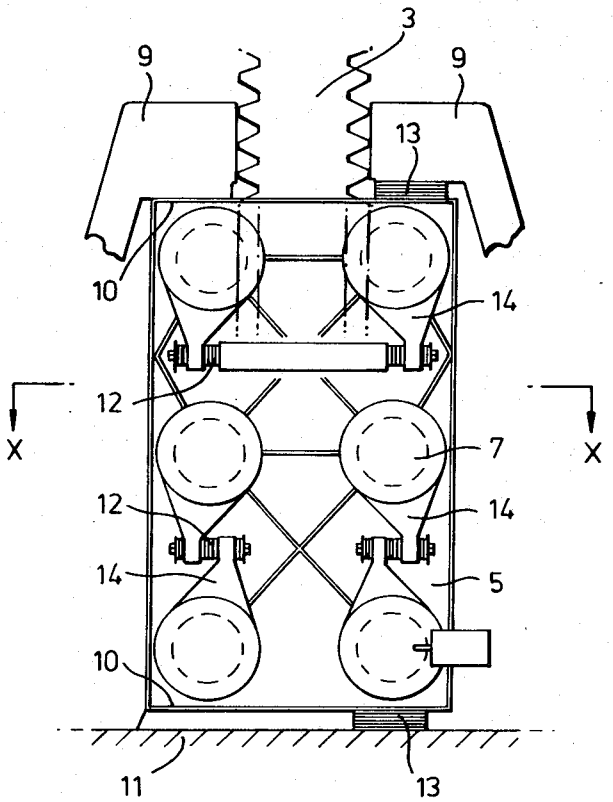
Figure 9A:
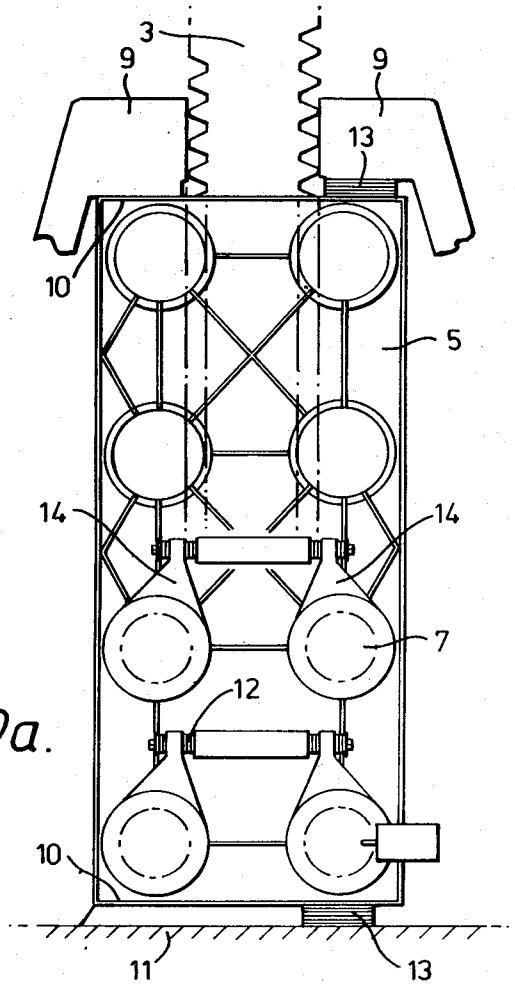
Figure 10:
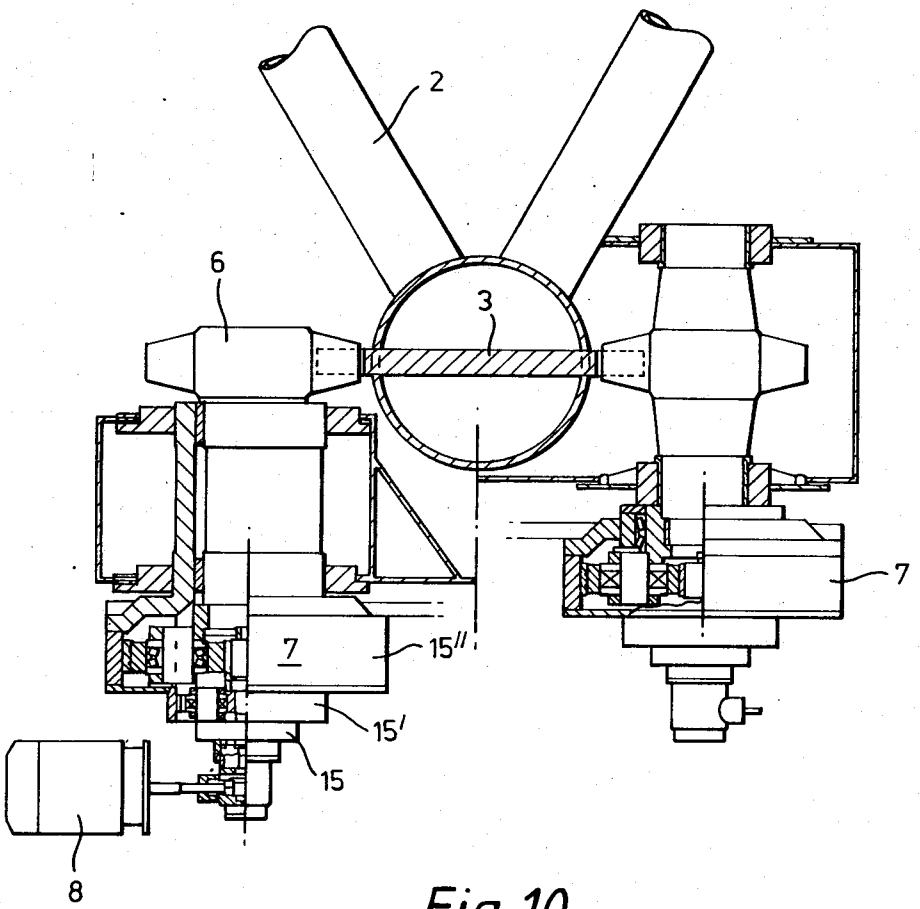
Figure 13A:
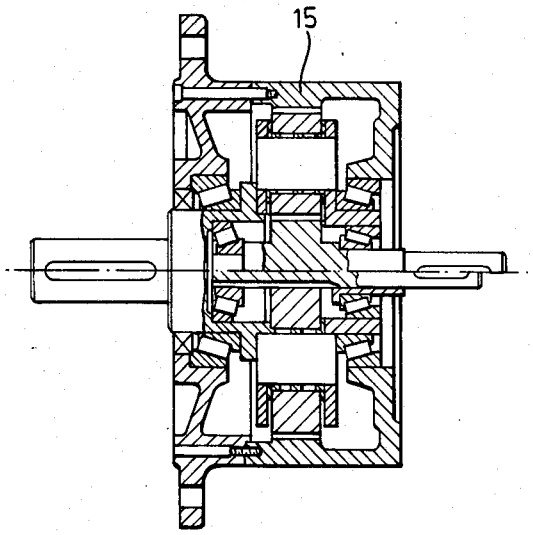
Figure 13B:
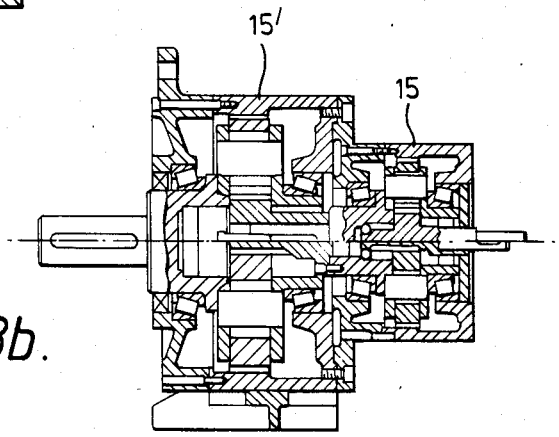
Figure 13C:
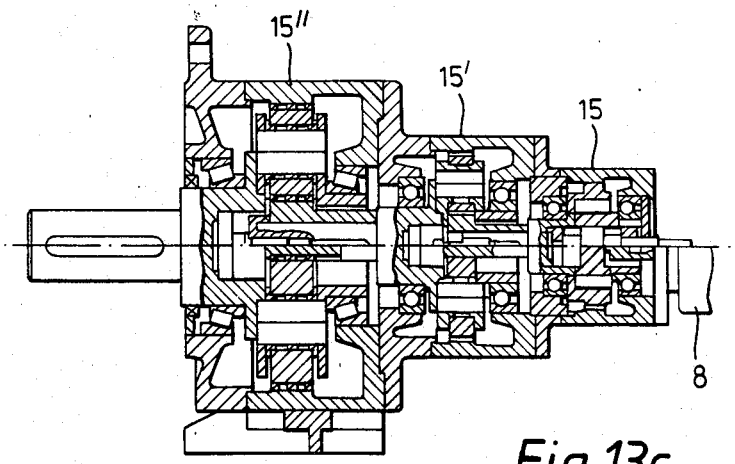
Figure 14A:
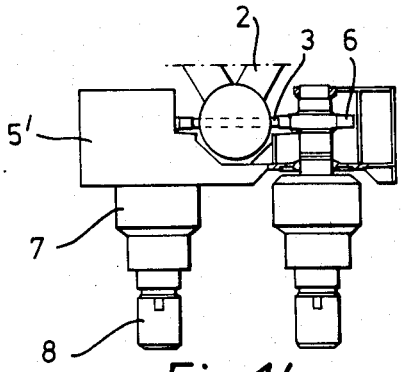
Figure 14B:
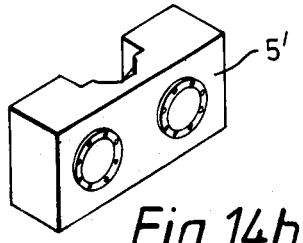
Figure 14C:
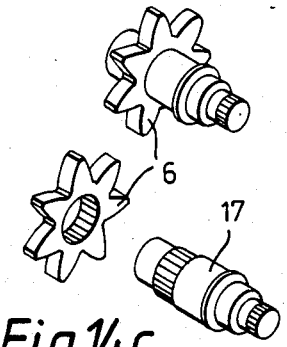
Figure 15A:
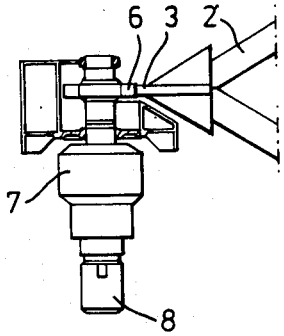
Figure 15B:
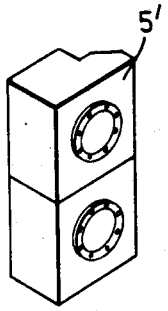
Figure 15C:
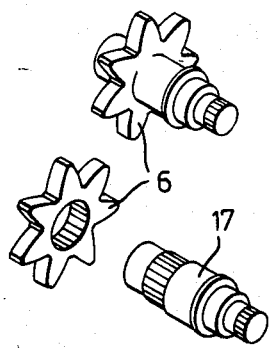
Figure 16A:
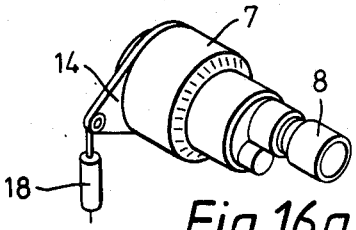
Figure 16B:
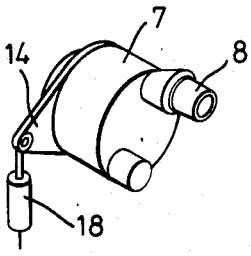
Figure 14D:
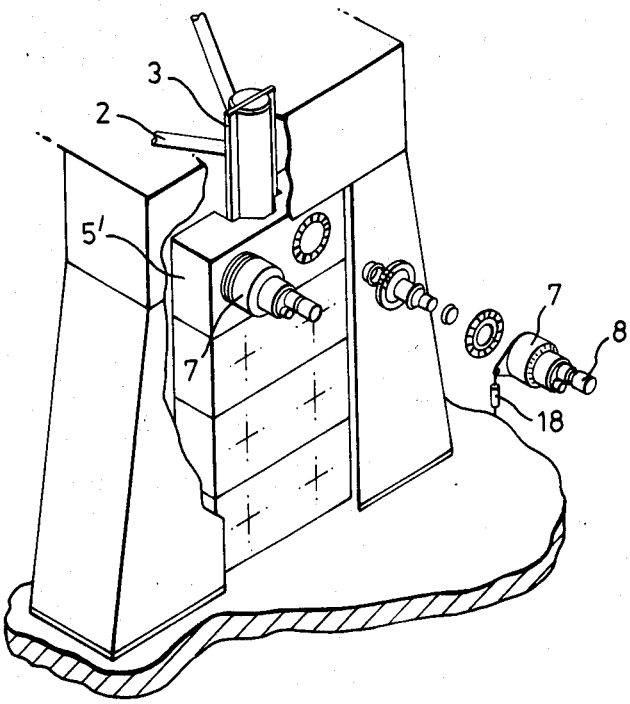
Figure 15D:
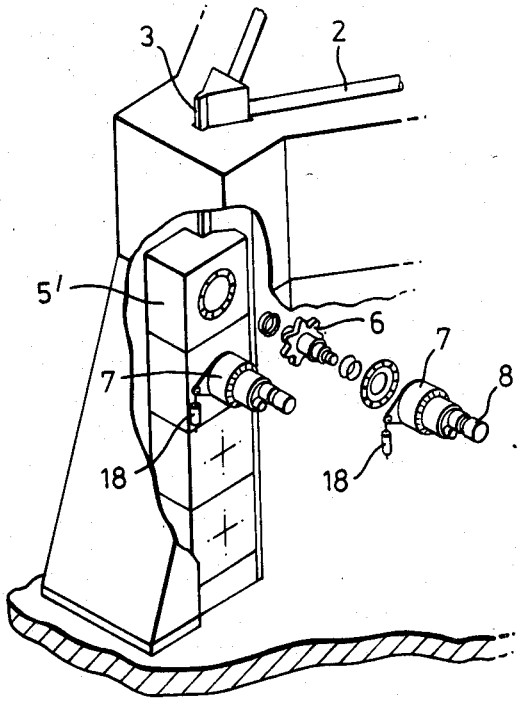

The invention and its details will be described in more detail in the following with reference to the attached drawings, wherein FIG. 1 shows a jack-up platform provided with prior-art lifting mechanisms, FIG. 2 is a schematical top view of a platform leg provided with two-sided racks and of prior-art lifting mechanisms, FIG. 3 is a top view on an enlarged scale of one corner of the leg shown in FIG. 2 and of one lifting mechanism, FIG. 4 shows the lifting mechanism of FIG. 3 viewed in the direction of the arrow A, FIG. 5 shows the same viewed in the direction of the arrow B, FIG. 6 is a top view of a platform leg provided with one-sided racks and of prior-art lifting mechanisms, FIG. 7 shows one corner of the leg shown in FIG. 6 and one lifting mechanism seen in the direction of the arrow C and on an enlarged scale, FIG. 8 shows the same seen in the direction of the arrow D, FIGS. 9*a* and 9*b* show a lifting mechanism in accordance with the invention and one corner of a platform leg provided with a two-sided rack, as two different embodiments, FIG. 10 is an enlarged sectional view at X—X in FIG. 9*b*, FIG. 11 shows a lifting mechanism in accordance with the invention applied in connection with a leg provided with a one-sided toothed rack, FIG. 12 shows the same on an enlarged scale and viewed from above, FIGS. 13*a* to 13*c* shows three different gearings used in a lifting mechanism in accordance with the invention, FIGS. 14*a* to 14*d* show a series of illustrations representing the assembly of a lifting mechanism in a way in accordance with the invention when a two-sided rack is used, FIGS. 15*a* to 15*d* show a similar series of illustrations when a one-sided rack is used, and FIGS. 16*a* and 16*b* show two different gearings which can be used in connection with FIGS. 14*a* to 14*c* and 15*a* to 15*c*.

The drilling platform 1 shown in FIG. 1 is provided with three legs, which are lowered to the sea bottom at the drilling site, and the platform is raised from the sea level supported on the legs. Each of the three corners of the legs is provided with a toothed rack 3, along which the cogwheels of the lifting mechanism 4 climb.

FIGS. 2 to 5 illustrate a prior-art lifting mechanism in connection with a two-sided rack. Each corner of a platform leg 2 is provided with a lifting mechanism and with a two-sided toothed rack. The lifting mechanism is provided with a frame 5, with cogwheels or pinions 6 climbing along the rack 3 at two sides of it, with gearings 7 and with drive machines 8. The total number of pinions is 2 to 8, normally 2 or 3 at each side of the toothed rack. The frame of the lifting mechanism is attached to the platform at its top end and at its bottom end. The attachment may be either resilient or rigid. Guide faces 9 receive horizontal forces coming from the leg.

FIGS. 6 to 8 show a prior-art lifting mechanism in connection with a one-sided rack.

As a rule, the platform lifting machines are integrated drives in accordance with FIGS. 2 to 5 and 6 to 8, wherein the lifting machine must be constructed complete, as shown in the figures, before installation, among other things, because of the precision of fitting of the cogwheels.

FIGS. 9*a* and 9*b* show two alternative embodiments of a lifting mechanism in accordance with the invention in connection with a two-sided rack. The left side and the right side in the figures illustrate two different, alternative attachments of the lifting mechanism. At the left side, the lifting mechanism is fixed to the platform frame 11 rigidly by welding at points 10, whereat two adjoining gearings 7 are interconnected by means of resilient elements 12. At the right side of FIG. 9, on the contrary, rubber springs 13 have been used in the attachments between the frame of the lifting mechanism and the frame of the platform.

FIG. 10 shows two different, alternative gearing constructions 7 at the left side and at the right side of the figure.

In the solution in accordance with the invention, the gearing 7 related to each pinion 6 is constructed as one individual module. These modules are, as such, attached to the holes provided in the frame of the lifting mechanism by means of bolts only when the drilling platform is being assembled. The torque arms 14 of two gearboxes placed one after the other or side by side are joined together so that the torques applied by the pinions to each gearbox are of opposite direction and thereby compensate for each other. FIG. 9*a* shows an alternative in which torque arms 14 placed side by side are interconnected, whereas FIG. 9*b* shows an alternative in which the lowest two gearboxes are interconnected being placed one after the other, at both sides of the toothed rack, and the uppermost gearboxes, placed side by side, are interconnected.

The torque arms 14 of two gearboxes placed side by side may be interconnected either by means of a resiliently attached rod 16 or by means of a hydraulic cylinder. Several hydraulic cylinders may be connected to the same pressure source, whereby the pressure is equalized between the different units.

The gearbox 7 is a modulated planetary gearbox, which consists of one or several planetary gears.

FIGS. 11 and 12 illustrate an application of the invention in connection with a one-sided rack.

In a solution in accordance with the invention, the nominal lifting capacity of one lifting mechanism is of the order of 75 to 400 tons per pinion (maximum load about 1000 tons per pinion).

A further essential feature of the invention is the design of the gear transmission so that the gearbox 7 itself is assembled out of uniform planetary gear modules 15, which may be attached to each other. FIG. 13 shows three different transmissions, a, b and c. The transmission a consists of a single planetary gear module 15, in the transmission b two modules 15 and 15' have been used so that the module 15 driven by the drive machine drives the module 15', which again drives the pinion. In a corresponding way, in the transmission c, there are three modules, 15, 15' and 15''.

By planning a highly limited number, 10 to 15 pcs., of modules (gearboxes) 15 of different sizes, it is possible to cover all possible variations concerning the gear transmission itself. The transmission type is a planetary gear train. Since there are numerous different platform types, by means of the system described above and by means of variations in the frame of the lifting mechanism (to which said frame the gearbox is attached) an application can be made rapidly for any platform whatsoever, e.g. for platforms whose legs are provided with one or two racks. The gear transmission can be detached from the frame separately as a whole unit.

As an essential feature should be mentioned the insensitivity of the cogwheels to any deformations of the supporting casing, because, as a rule, attempts are made to use the casing as a receiver of horizontal forces coming from the leg, which forces attempt to deform the casing in the lateral direction. Thereby, in conventional integrated lifting mechanisms, cogwheels placed inside the frame may be damaged.

It should be noticed that the present-day standard planetary gear trains are not optimal, because they were originally designed for continuous operation, whereas the lifting mechanism transmissions of drilling platforms are in operation extreme seldom.

FIGS. 14*a* to 14*d* illustrate the assembly of a lifting mechanism out of modular components in connection with a two-sided toothed rack. Into a frame module 5', two pinions 6 are fitted onto shafts 17, onto which gearboxes 7 with their drive mechanisms 8 are mounted. For example, four frame modules 5' are fitted one above the other. The torque arms 14 of two gearboxes placed one after the other are interconnected by means of hydraulic cylinders 18.

FIGS. 15*a* to 15*d* illustrate the same thing in connection with a one-sided toothed rack.

FIGS. 16*a* and 16*b* illustrate two different gearboxes. Depending on the required transmission ratio, either one of them can be used together with the components shown in FIGS. 14*a* to 14*c* or 15*a* to 15*c*.

It is noticed that the mechanism is assembled out of the same components both for legs provided with one-sided racks and for legs provided with two-sided racks, only the frame modules differing from each other.

By using two, maximum three, different frame modules, six, maximum eight, different pinion sizes, as well as ten, maximum fifteen, different gearbox modules, it is possible to assemble all possible lifting mechanism alternatives that may be required in practice. The calculation of tenders also becomes considerably easier, because the mechanism always consists of standard components.

What is claimed is:

1. A lifting mechanism for a jack-up platform comprising a platform, a platform support frame for supporting said platform and at least one leg for supporting said platform support frame, said leg having a toothed rack extending therealong, said platform support frame being movable relative to said at least one leg, said lifting mechanism comprising:

a lifting frame, adjacent said at least one leg and movable relative thereto, connected to said platform support frame; and lifting means, connected to said lifting frame and engaging said toothed rack, for moving said lifting frame relative to said leg;

wherein said lifting means comprises:

two cog wheels engaging said toothed rack, said cog wheels being rotatable so as to move along said toothed rack;

first gear box means for one of said cog wheels, having a first torque arm to transmit torques produced by said one of said cog wheels moving along said rack, for rotating said one of said cog wheels in response to a first rotational force;

first motor means, operably associated with said first gear box means, for providing said first rotational force;

second gear box means for the other of said two cog wheels, having a second torque arm to transmit torques produced by said other of said cog wheels moving along said rack, for rotating said other of said cog wheels in response to a second rotational force;

second motor means, operably associated with said second gear box means, for providing said second rotational force;

wherein said first and second torque arms are interconnected so that the torques produced by the cog wheels compensate for each other.

2. The lifting mechanism according to claim 1, wherein said toothed rack is a two-sided toothed rack and said first and second gear box means are located side-by-side.

3. The lifting mechanism according to claim 1, wherein said first and second gear box means are located one above the other.

4. The lifting mechanism according to claim 1, wherein said first and second torque arms are interconnected through a resilient element.

5. The lifting mechanism according to claim 4, wherein said resilient element is a hydraulic cylinder.

6. The lifting mechanism according to claim 1, wherein said platform support frame and said lifting frame are connected through at least one resilient member.

7. The lifting mechanism according to claim 1, wherein each of said first and second gear box means comprises at least one planetary gear.

8. The lifting mechanism according to claim 7, wherein each of said first and second gear box means comprises two or more planetary gears of different sizes mounted in series.

9. The lifting mechanism according to claim 1, wherein each of said first and second gear box means is a module separate in relation to said lifting frame.

10. The lifting mechanism according to claim 1, wherein said one of said cog wheels, said first gear box means, and said first motor means form a first discrete module; and said other of said cog wheels, said second gear box means, and said second motor means form a second discrete module.

* * * * *